United States Patent [19]

Erlandson

[11] Patent Number: 4,562,945

[45] Date of Patent: Jan. 7, 1986

[54] GUN SLING

[76] Inventor: Dale L. Erlandson, P.O. Box 2, Antigo, Wis. 54409

[21] Appl. No.: 655,296

[22] Filed: Sep. 26, 1984

Related U.S. Application Data

[63] Continuation of Ser. No. 513,656, Jul. 14, 1983, abandoned.

[51] Int. Cl.[4] ..... F41C 27/00

[52] U.S. Cl. ..... 224/150; 224/202; 224/913

[58] Field of Search ..... 224/150, 151, 913, 202, 224/258; 24/2.5, 198, 199, 200, 163 R, 163 FC, 32, 316, 31 R, 31 F, 35

[56] References Cited

U.S. PATENT DOCUMENTS

| | | | |
|---|---|---|---|
| 193,303 | 7/1877 | Ward | 24/199 |
| 348,871 | 9/1886 | Wales | 24/199 |
| 1,043,425 | 11/1925 | Hirsh | 24/200 |
| 1,383,125 | 6/1921 | Kennedy, Jr. | 224/150 |
| 1,820,578 | 8/1931 | Mosgrove | 24/198 |
| 2,002,946 | 5/1935 | Jacobs | 24/200 X |
| 2,012,466 | 8/1935 | Goldsmith | 24/198 |
| 2,032,591 | 3/1936 | Pride | 24/200 X |
| 2,407,466 | 9/1946 | Alberts | 24/198 X |
| 2,812,123 | 11/1957 | Girton | 224/913 X |
| 2,928,154 | 3/1960 | Koehl | 24/163 FC |
| 3,064,271 | 11/1962 | Kuber | 24/200 X |
| 3,164,189 | 1/1965 | O'Link | 224/913 X |
| 3,290,696 | 12/1966 | Rosenzwieg | 24/198 X |
| 3,326,432 | 6/1967 | Banks et al. | 224/258 |
| 3,334,794 | 8/1967 | Saari et al. | 224/913 X |
| 4,158,938 | 6/1979 | Meechan et al. | 52/309.11 X |

FOREIGN PATENT DOCUMENTS

| | | | |
|---|---|---|---|
| 1271717 | 8/1961 | France | 24/163 FC |

*Primary Examiner*—Stephen Marcus
*Assistant Examiner*—Robert Petrik
*Attorney, Agent, or Firm*—Raymond W. Campbell

[57] ABSTRACT

A sling for guns which can also be used on other articles, the sling having a strap portion fastenable on both ends to the gun or article, with each end of the strap being doubled back and secured by a sliding type fastener. When used on a firearm the sling can be adjusted quickly for carrying the firearm in various positions and for steadying the firearm for accurate aiming. The adjustable features of the sling make it easily usable for different purposes, and many adjustments can be made without removing the strap from the article being carried.

14 Claims, 9 Drawing Figures

FIG. 4
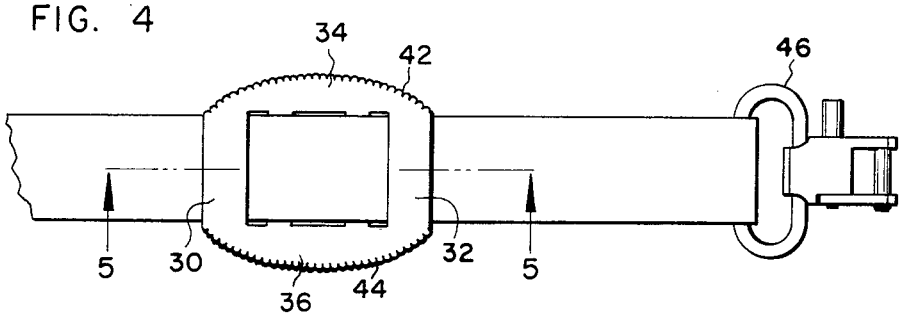
FIG. 5
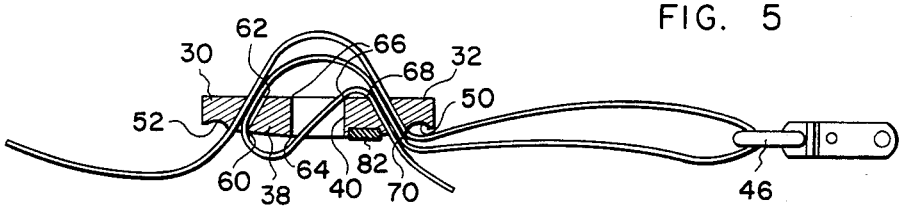
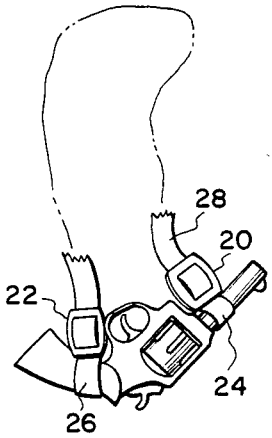
FIG. 3
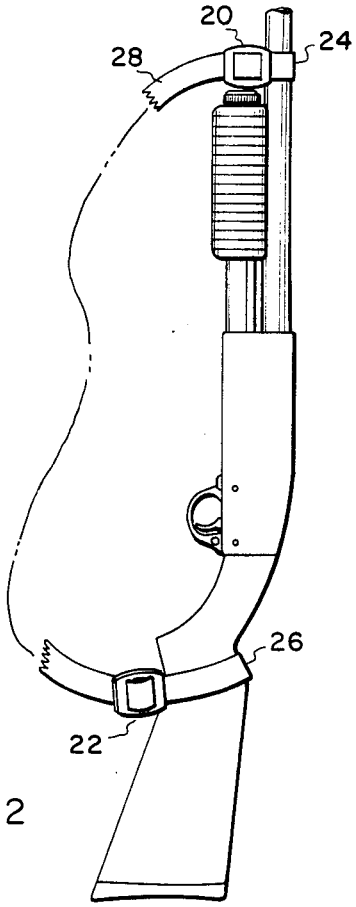
FIG. 2
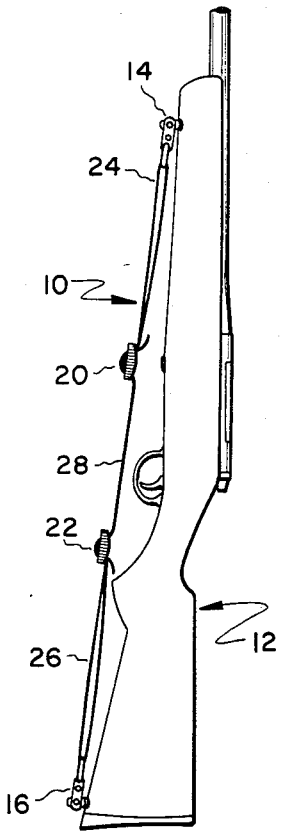
FIG. 1

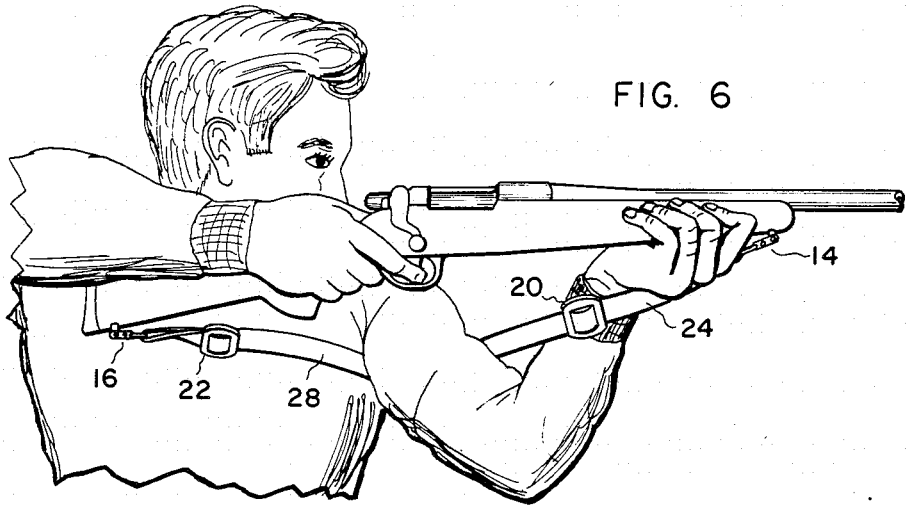
FIG. 6
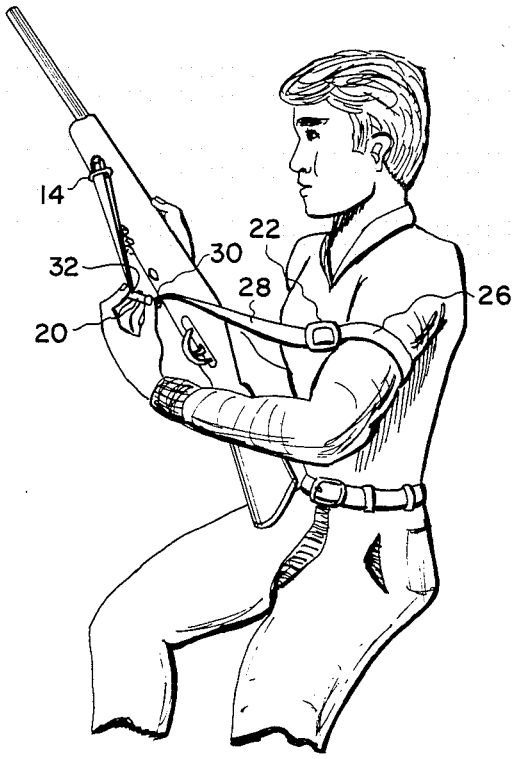
FIG. 7
FIG. 8
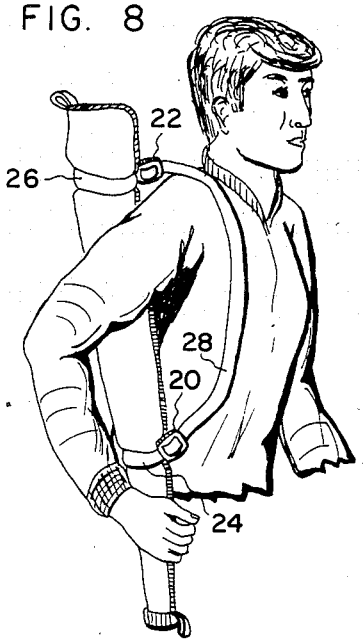
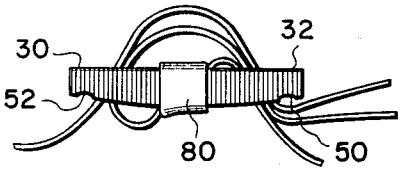
FIG. 9

GUN SLING

This is a continuation of co-pending application Ser. No. 513,656 filed on 07/14/83, now abandoned.

BACKGROUND OF THE INVENTION

1. Technical Field

This invention relates generally to the field of carrying straps for articles and specifically to the field of slings for carrying firearms.

2. Prior Art

In the past, slings in various different forms have been used for carrying firearms. A sling reduces the strain and effort required in transporting a firearm by transferring the weight of the firearm to the shoulder area of the person carrying the firearm. This reduces arm fatigue in addition to freeing the arms for carrying other objects or for carrying nothing, thereby improving balance when uneven or obstructed terrain is encountered. For carrying a rifle, for example, common gun sling arrangements include a relatively taut strap extending from the butt or shoulder resting area of the stock to a point under the barrel toward the muzzle end of the rifle. With the sling in this relatively taut position the rifle is carried somewhat vertically, usually behind one's shoulder, with the strap extending vertically over the front of the shoulder and the muzzle pointing either up or down. In the second carrying arrangement, the strap is again fastened at both ends to the rifle; however, the strap is somewhat less taut. In this arrangement the rifle can be carried angularly across the back of the person carrying it, with the strap extending angularly across the front of the person, from either shoulder to near the opposite waistline. In either of the aforedescribed carrying positions, the required length of the strap is dependent on the distance between the points at which the strap is fastened to the firearm, as well as on the size of the person carrying the firearm. Hence, the strap must be adjusted for various persons carrying the same firearm or for different firearms carried by the same person using the same gun sling.

In addition to carrying a firearm, slings are also used to aid in steadying the firearm for shooting. By strapping the rifle to the arm of the person firing it, various muscle groups of the upper body can be used in an opposing manner, thereby steadying the gun. Again, various gun sling positions are used when a firearm is fired. In one position, commonly called the "hasty sling" position, the strap of the sling is fastened at both ends to the firearm, and the gun supporting arm of the marksman is intertwined with the strap. The length required for the strap will vary from firearm to firearm, again dependent on the distance between the points at which the sling is attached to the firearm; and the required length of the sling will also vary from marksman to marksman, depending on arm length and thickness and general upper body size as well as on the preferred arm orientation for the marksman in relationship to his firearm.

In the second shooting position, commonly referred to as a "target sling" position, the sling is attached to the firearm only at the forward or muzzle end, and the distal end of the strap is secured around the upper arm of the marksman. Proper adjustment of the sling must be made at both ends, on the one end to snuggly surround the marksman's upper arm, and at the other end to achieve a proper overall sling length which will hold the butt of the firearm against the marksman's shoulder when the gun is held in the shooting position. Again, these adjustments will vary from person to person as well as from firearm to firearm.

Frequently, it is desirable to alter a gun sling from one position to another. For example, when hunting, a hunter may carry his rifle in an over-the-shoulder position while walking to his desired hunting area. Once there, it may be desirable to then adjust the firearm to a hasty sling position, or if stationary hunting is being done, the hunter may even desire to use the target sling position. If game is encountered unexpectedly, it is desirable to change from a carrying position to a hasty or target sling position quickly, easily, and with little commotion to frighten the game.

Slings used in the past frequently were incapable of convenient, quick alteration from one sling position to another. Often belt-type buckles were used at one or the other or both ends of the sling, and adjustment of the sling required changing the hole engaging pin of the buckle from one hole to another. Normally, this cannot be done easily with a sling which is secured around the arm of the marksman, and proper adjustment can require a trial-and-error type approach to positioning the strap in various holes until the proper one for the particular firearm and marksman is achieved. Since this type of sling will have only discrete locations into which it can be adjusted, a particular marksman with a particular firearm may need to create additional intermediate holes in which the belt-type buckle can be secured, as his most comfortable sling position may require securing the engaging pin intermediate the supplied securing locations. Again, this will only be determined from trial and error, and if a person not normally using a particular firearm or sling is in a situation where he must use the firearm or sling, he may not be able to properly adjust it easily for utmost comfort.

Other types of slings commonly used in the past have included various loops, straps and short lengths of webbing secured and fastened by buckles, rivets, or other keepers, and frequently the known slings are attached to the firearm in fashions which are inconvenient for rapid detachment or adjustment.

SUMMARY OF THE INVENTION

It is therefore one of the principal objects of the present invention to provide a gun sling which can be used for carrying and shooting a firearm, and which can be adjusted easily for use in all carrying and shooting positions.

It is another object of the present invention to provide a gun sling which can be adjusted quickly and easily for various firearms and for various marksmen without a trial-and-error type fitting of the sling length.

A further object of the present invention is to provide a carrying strap which can be used for carrying other articles in addition to firearms.

A still further object of the present invention is to provide a gun sling which can be used on various different types of firearms, either with or without swivels, and which can be used for carrying shotguns, pistols, and guns in gun cases.

Yet another object of the present invention is to provide an over-the-shoulder type carrying strap which resists sliding relative to the shoulder, either across the shoulder or off the shoulder.

These and other objects are achieved in the present invention by providing a gun sling or carrying strap having a strap portion, preferably of nylon webbing, which is looped back on itself on either end and secured on its ends by sliding type fasteners, such as, for example, four bar buckles. The strap can be used on rifles with swivels or on firearms without swivels such as shotguns, and the sling can be used for carrying pistols and guns in cases. Either end of the carrying strap can be looped and adjusted, and adjustment is made quickly by tilting the angle of the four-bar buckle and sliding the strap through the buckle. The loops formed at the ends of the strap are held securely when the buckle is substantially parallel to the strap, and the buckle will be in the secured position when not angled by the user. Thus, when adjusted, the sling stays securely positioned, and since discrete belt-buckle type securing holes are not required, the strap has infinite adjustment positions, thereby making it suitable for use by all marksman on all types of firearms, as well as for carrying other objects. Adjustment in length can be made quickly and quietly, even if one end of the sling is secured about the marksman's arm. A non-slip body of rubber or the like is provided under the buckle to prevent slippage when the sling is used as an over-the-shoulder type carrying strap.

Further objects and advantages of the present invention will become apparent from the detailed description and the accompanying drawings.

BRIEF DESCRIPTION OF THE DRAWINGS

FIG. 1 is a perspective view of a gun sling embodying the present invention, the sling being shown attached to a rifle having front and rear swivel attachment sites.

FIG. 2 is a fragmentary perspective of a sling embodying the present invention attached to a shotgun.

FIG. 3 is a fragmentary view of the sling embodying the invention, the sling being shown for carrying a pistol.

FIG. 4 is a top plan view of one end of the sling.

FIG. 5 is a cross-sectional view of the end of the sling shown in FIG. 4, taken on line 5—5 of the latter Figure.

FIG. 6 is a perspective view showing the sling used in the hasty sling position.

FIG. 7 is a perspective view showing a marksman adjusting the sling for use as a target sling.

FIG. 8 is a perspective view of the gun sling embodying the present invention, showing use for transporting a cased firearm.

FIG. 9 is a side elevational view of a modified sliding type fastener for the sling.

DETAILED DESCRIPTION OF THE PREFERRED EMBODIMENT

Referring now more specifically to the drawings; and to FIG. 1 in particular, numeral 10 designates a gun sling embodying the present invention, which is shown attached to a rifle 12. The sling is shown to be in the taut or parade position; however, one of the primary advantages of the present sling is that it can be adjusted quickly for other carrying and shooting positions.

Sling 10 is shown to be attached to forward and rearward swivels 14 and 16, respectively. The swivels are conventional firearm accessories to which the sling can be attached, and many different designs for swivels can be used. As a result of the uncomplicated manner in which the sling is attached to a swivel and the infinite adjustment positions for the sling, normally a sling embodying the present invention can be substituted for other types of slings without modification of the gun itself or of the swivels already secured to the stock.

The sling comprises an elongated strap or web which is doubled back on itself on both of its ends and secured to itself at its ends by sliding type fasteners 20 and 22. Arranged in this manner, the strap forms two loops designated 24 and 26 in the drawings, with a single layer strap section 28 disposed between the loops. The sizes of the loops and the length of the strap section 28 are varied by sliding the fasteners, thereby adjusting the sling to fit the purpose to which it is being applied. Nylon has been found to be a suitable material for the strap; however, heavy canvas, leather or other materials may also be used.

The sliding type fasteners are such that the free ends of the strap are held tightly therein, while intermediate lengths of the strap can slide therethrough. Four-bar buckles threaded in an unconventional manner can be used for the fasteners. Plastic or metal are suitable materials for the buckles which have a generally rectangular outer frame which includes outer strap engaging bars 30 and 32 and side segments 34 and 36. The buckle further includes inner strap engaging bars 38 and 40. The buckle thus has four strap engaging bars, designated by numerals 30, 32, 38 and 40, and the manner in which the strap is threaded among the bars of the buckle will be described more completely hereinafter. When used on a firearm for hunting it will frequently occur that the sling will be adjusted while the user is wearing gloves, while the user's hands are wet and/or cold or under other adverse conditions. To facilitate movement of the buckle along the strap during adjustment, it has been found that side segments 34 and 36 should be gently rounded outwardly in shape. To further facilitate grasping the buckle, serrated portions 42 and 44 are provided on the gently rounding outer edges of side segments 34 and 36, respectively.

The manner in which each of the buckles is threaded is shown in FIG. 5. With the buckle being oriented generally on top of the strap, the end of the strap is passed under the outer strap engaging bar which will be farthest from the loop, bar 30 in the drawings, above the two inner strap engaging bars 38 and 40, and under the other outer strap engaging bar 32. A sufficient length of strap is pulled through the buckle to allow formation of a loop by doubling the end of the strap under itself, with the reference top side being that with the outer strap engaging bars on top of it. While forming the loop and before the final buckle threading is performed, the strap is passed through a suitable ring 46 or other coupler of the sling swivel, when the sling is used with a swivel. The end of the strap is brought under the first layer of strap under outer strap engaging bar 32, above inner strap engaging bars 40 and 38 but under the first strap layer above the inner bars, and then under the strap layer disposed between strap engaging bars 30 and 38. The strap is passed under inner strap engaging bar 38, thereby forming a loop around the bar, back above inner strap engaging bar 40, under the first two strap layers thereabove, and between bar 40 and the two strap layers below outer strap engaging bar 32. The strap is pulled taut through the buckle, and threading of the one end and buckle is complete. The other end of the strap is threaded through another buckle in a similar fashion.

To adjust the sling, the relative lengths of the loops are changed by sliding the buckles along the strap. To move a buckle, the buckle is tilted as shown in FIG. 7, with the outer strap engaging bar farthest from the loop being tilted toward the strap passing under it and the outer strap engaging bar nearest the loop being tilted away from the strap passing under it. The serrated, gently rounded side segments can be grasped for tilting the buckle; however, it has been found that this can be more easily performed by grasping and elevating outer strap engaging bar 32. To assist one in doing this under adverse conditions, as may be encountered while hunting, a channel 50 has been provided for inserting a finger under the bar. Since the bars are otherwise symmetrical, a channel 52 similar to channel 50 has been provided in the underside of outer bar 30 as well. In this way the buckle can be installed with either of the outer bars being closest to the loop, thereby simplifying installation.

Once the buckle has been placed in the tilted position, the upper layer of strap in the buckle can be slid through the buckle; however, the lower layer of strap in the buckle, that nearest the strap end, will not move relative to the buckle. When the buckle is released and force is applied against the sling, tension on the strap within the buckle is such that the position of the buckle relative to the length of the strap is secured. This results from the angles at which the strap wraps around the strap engaging bars and particularly against the edges thereof. As shown in FIG. 5, for example, when the strap is pulled tightly through the buckle, the strap is held firmly against certain edges of the strap engaging bars of the buckle. Edges identified in the drawings with numerals 60, 62, 64, 66, 68 and 70 are all involved with the securing phenomena.

Since the end of the strap is not attached permanently to the buckle, as in the conventional manner for using a four-bar buckle, the present sling can be interchanged quickly and easily for various purposes. The buckle can be unthreaded and rethreaded quickly if the sling is transferred from one firearm to another. For convenience, however, particularly when the sling is used on a firearm and used for carrying or as a hasty sling in addition to use as a target sling, it is desirable to use a swivel having a quick connect ring so that the ring can be attached to the sling and quickly connected to or disconnected from the base of the swivel.

Adjustment of the sling is easy and can be performed with one hand. This is of particular significance when the sling is used as a target sling for shooting. The lower loop 26 is disconnected from the butt end swivel, the loop is opened and slid over the shooter's arm, and the buckle 22 is slid toward the end of the loop to tighten the loop around the arm. The muzzle end buckle 20 is adjusted to shorten or lengthen loop 24, thereby lengthening or shortening the overall sling length respectively. This can be done while the butt of the stock is held against the shooter's shoulder. Since either buckle has an infinite number of adjusted positions along the strap, the sling can be perfectly adjusted in overall length as well as in tightness around the shooter's arm. This is beneficial over those sling designs which have discrete adjustment positions such as conventional belt buckles with holes. Since the sling can be adjusted while the gun is in a shooting position, time is not wasted in a trial-and-error type fitting adjustment. Further, the sling can be adjusted rapidly from a carrying position to a shooting position with little noise or commotion which may startle game. Although the sling can be adjusted with the gun butt in shooting position, it is generally easier to make the adjustment with the gun in a more vertical position as shown in FIG. 7. In either case, the sling can remain secured to the shooter's arm, and accurate adjustment is quick and easy.

When slings or other straps are used for carrying firearms and other articles in over-the-shoulder carrying positions, a problem is often encountered in that the weight of the gun or article and the swinging movement resulting from walking causes the sling to slide across the shoulder. This can result in the lower end of the gun, for example, jutting out in front of the person, or the sling may even slide off the person's shoulder, causing the gun to fall to the ground. To minimize this problem, a layer or area of material having a high coefficient of friction against fabric is disposed on the bottom surface of the buckle. Two different embodiments are shown in the drawings. A band 80 of rubber or rubber-like material can be used around the buckle. This embodiment has the advantage of further holding the strap in the buckle as threaded, as shown in FIG. 9, but has the disadvantage of being an additional separate piece. Normally, one band is sufficient and can be used on whichever buckle rests against the person transporting the firearm; however, for convenience in carrying the gun in either muzzle up or muzzle down positions it is preferable to have bands on both buckles. The bands have other beneficial features as well. The bands act as bumpers to reduce the noise from and to reduce stock scratching caused by the buckles hitting the stock. Further, the bands provide a readily graspable body on the buckle. Thus, the band can be used on square buckles not having a rounded edge or serrated section.

The second embodiment includes a body of material 82 similar to the band 80, the body being disposed on the back of the buckle, either on a surface of one of the inner strap engaging bars, or in a groove in the bar, but slightly protruding therefrom. In this embodiment the high friction material is secured to the buckle, however to make the buckles interchangeable and ensure that the gun can be carried in all positions, it is preferred that both buckles of the sling have the high friction material on them. The gun can then be carried in either a muzzle up position or in a muzzle down position, and the high friction material will assist in holding the sling in place on a person's shoulder.

The present sling can also be used without swivels by securing the loops about the firearm or other article. FIG. 2 shows the manner in which the sling can be used on a shotgun or rifle without swivels. FIG. 3 shows use of the sling for carrying a pistol. FIG. 8 shows the sling being used to carry a cased firearm. This is another of the particular advantages of the present sling over the prior art. Because of its ease and rapidity of attachment and removal, it is very convenient to remove the sling from the gun before the gun is cased, and to thereafter attach the sling to the case for carrying.

The present sling can also be applied to other uses. For example, the sling can be used for carrying other articles or packages such as suitcases, ammunition boxes or the like. Additionally, the sling can be used as an animal leash, either with a collar or without a collar, using one of the loops secured to the collar, or alternatively, using the loop as a collar around the animal's neck. The other loop can be held or even secured about a person's wrist.

The present invention can perform all functions of conventional gun slings, being usable for all carrying and shooting positions. Changing from one position to another and adjusting the strap to the person using it is easier, quicker and more accurate than with conventional slings. Further, the present invention can be used for shotguns or rifles without anchor points in the stock and can also be used for carrying pistols.

Although one embodiment and one modification of a gun sling have been shown and described in detail herein, various other changes can be made without departing from the scope of the present invention.

I claim:

1. A strap suitable for use as a gun sling for carrying a firearm and steadying it for aiming and also suitable for carrying other articles, said strap comprising:

a. an elongated web having sufficient strength for supporting a gun or other article suspended therefrom;
   i. said web being sufficiently flexible to permit it to be folded back on itself;
   ii. said web being folded back on itself along a portion near each of its ends to form a loop at each end and an intermediate web section;

b. a sliding type fastener disposed at the base of each of said loops between said loops and said intermediate web section;
   i. said web being threaded through said fasteners and said fasteners being generally aligned with said loops and said intermediate web section, with said intermediate web section and one of said loops extending outwardly from opposite ends of each of said fasteners, said fasteners securing the sizes of said loops by restricting movement of the web relative to said fasteners when said fasteners are permitted to equilibriate in position relative to said web;
   ii. each of said fasteners having a forced position relative to said web in which intermediate web lengths may pass through said fasteners to become part of and enlarge a loop, and a part of the web forming a loop can pass through a fastener to become part of said intermediate web section and decrease the size of the loops, the extreme end portions of said web remaining fixed in position relative to said fasteners while other portions of said web are moved through said fasteners; and
   iii. said extreme end portions being engaged with but not directly attached to said fasteners and being held therein by said intermediate web lengths.

2. A strap as defined in claim 1 in which said sliding type fasteners are four-bar buckles, each having first and second outer strap engaging bars and first and second inner strap engaging bars, and the loop secured by each buckle extends outwardly from the space between the first outer strap engaging bar and the inner strap engaging bar adjacent the first outer strap engaging bar and said intermediate web section extends outwardly from between said second outer strap engaging bar and the inner strap engaging bar adjacent said second outer strap engaging bar.

3. A strap as defined in claim 2 in which a body having a high friction surface is provided on the bottom of each of said buckles.

4. A strap as defined in claim 2 in which a body having a high friction surface is provided on the bottom of at least one of said buckles.

5. A strap as defined in claim 4 in which said body is adhered directly to said at least one of said buckles.

6. A strap as defined in claim 4 in which said body is a band surrounding said at least one of said buckles.

7. A strap as defined in claim 2 in which the sides of said buckles are curved outwardly.

8. A strap as defined in claim 2 in which serrated sections are provided on the side edges of said buckles.

9. A strap as defined in claim 8 in which the serrated side edges of said buckles are curved outwardly.

10. A strap as defined in claim 9 in which a body having a high friction surface is provided on the bottom of at least one of said buckles.

11. A strap as defined in claim 10 in which a depression is provided in each of said buckles on the bottom surface of said first outer strap engaging bars, said depressions extending along a substantial amount of the lengths of said first outer strap engaging bars.

12. A gun sling comprising an elongated web having a first end securable to a gun and a second end securable to an arm of a shooter with an intermediate web section extending between said ends; said first end including a loop formed from said web being doubled back on itself, and a four bar buckle securing said loop, said four bar buckle having first and second outer bars and first and second inner bars, said first bars being spaced from each other but adjacent and said second bars being spaced from each other but adjacent, said web being threaded through said buckle with said loop extending outwardly from between said first outer bar and said adjacent first inner bar of said buckle, said intermediate web section extending outwardly from between said second outer bar and said second inner bar, and an extreme end portion of the web at said first end being disposed between said first inner bar and said loop in the space between said first inner bar and said first outer bar.

13. A gun sling as defined in claim 12 in which said second end includes a loop formed by said web, and a four bar buckle securing said web, said second mentioned four bar buckle having first and second outer bars and first and second inner bars spaced from but adjacent respectively said second mentioned first and second outer bars, said second mentioned loop extending outwardly from between said first inner bar and said first outer bar of said second mentioned buckle and said intermediate web section extending outwardly from between said second inner bar and said second outer bar of said second mentioned buckle.

14. A gun sling as defined in claim 13 in which said first outer bars include finger grip depressions, and side segments of said buckles include grip enhancing surfaces.

* * * * *